US011801403B2

(12) United States Patent
Yao et al.

(10) Patent No.: US 11,801,403 B2
(45) Date of Patent: Oct. 31, 2023

(54) METHOD AND MASK FOR REDUCING INHALATION OF MICROORGANISMS

(71) Applicant: The Hong Kong Research Institute of Textiles and Apparel Limited, Hong Kong (HK)

(72) Inventors: Lei Yao, Hong Kong (CN); Xiao Liao, Hong Kong (CN); Yongli Wang, Hong Kong (CN); Siyu Lin, Hong Kong (CN)

(73) Assignee: The Hong Kong Research Institute of Textiles and Apparel Limited, Hong Kong (CN)

( * ) Notice: Subject to any disclaimer, the term of this patent is extended or adjusted under 35 U.S.C. 154(b) by 1186 days.

(21) Appl. No.: 16/263,139

(22) Filed: Jan. 31, 2019

(65) Prior Publication Data

US 2019/0275358 A1 Sep. 12, 2019

(30) Foreign Application Priority Data

Mar. 9, 2018 (CN) ..... 201810196042.5

(51) Int. Cl.
*A41D 13/11* (2006.01)
*A62B 18/02* (2006.01)
*A62B 23/02* (2006.01)

(52) U.S. Cl.
CPC ..... *A62B 18/025* (2013.01); *A62B 23/02* (2013.01); *A41D 13/11* (2013.01)

(58) Field of Classification Search
CPC ... B03C 2201/26; A62B 18/025; A62B 23/02; A41D 13/11; A41D 13/1107; A41D 13/1161; A41D 13/1192
See application file for complete search history.

(56) References Cited

U.S. PATENT DOCUMENTS

2004/0000313 A1* 1/2004 Gaynor ..... B01D 39/1623 128/205.27

FOREIGN PATENT DOCUMENTS

CN 102652584 A * 9/2012
CN 103829408 A * 6/2014
CN 103829408 A 6/2014
(Continued)

OTHER PUBLICATIONS

CN102652584A_machine translation.pdf.*
(Continued)

*Primary Examiner* — Camtu T Nguyen
(74) *Attorney, Agent, or Firm* — Spruson & Ferguson (Hong Kong) Limited

(57) ABSTRACT

The present disclosure provides a method for reducing the inhalation of microorganisms, a washable mask for reducing the inhalation of microorganisms, applications of the mask and a method for manufacturing the same. The method for reducing the inhalation of microorganisms includes the steps of: providing a mask with a breathing zone, the breathing zone being used for covering a breathing part of a user; arranging two or more magnets around the breathing zone of the mask, the magnets generating a three-dimensional magnetic field, so as to change the moving trajectories of charged microorganisms in gas to be inhaled thereby increasing the probability of the microorganisms being captured by the filtering material.

11 Claims, 3 Drawing Sheets

(56) References Cited

FOREIGN PATENT DOCUMENTS

CN 106880103 A 6/2017

OTHER PUBLICATIONS

CN103829408A_machine translation.pdf.*
CN106889676 A, Jun. 2017.*
First Office Action with Search Report of CNv issued by the China National Intellectual Property Administration (CNIPA) of the PRC dated Jun. 5, 2020.
WHO. Disease outbreaks by year. [cited Aug. 18, 2016]; Available from: http://www.who.int/csr/don/archive/year/en.
Prevention Strategies for Seasonal Influenza in Healthcare Settings. [cited Sep. 4, 2014]; Available from: http://www.cdc.gov/flu/professionals/infectioncontrol/healthcaresettings.htm.
Mukerji et al., Review of economic evaluations of mask and respirator use for protection against respiratory infection transmission. BMC Infectious Diseases, 2015. 15(1).
Seto et al., Effectiveness of precautions against droplets and contact in prevention of nosocomial transmission of severe acute respiratory syndrome (SARS). The Lancet, 2003. 361(9368): p. 1519-1520.
Tambyah, Severe acute respiratory syndrome from the trenches, at a Singapore university hospital. The Lancet Infectious Diseases, 2004. 4(11): p. 690-696.
Taylor et al., Public health measures during an anticipated influenza pandemic: Factors influencing willingness to comply. Risk Management and Healthcare Policy, 2009:2 9-20.
Paniz-Mondolfi et al., Resurgence of Vaccine-Preventable Diseases in Venezuela as a Regional Public Health Threat in the Americas. Emerging Infectious Diseases, 2019. 25(4): p. 625-632.
Jefferson et al., Physical interventions to interrupt or reduce the spread of respiratory viruses: systematic review. Bmj, 2008. 336(7635): p. 77-80.
Sim et al., The use of facemasks to prevent respiratory infection: a literature review in the context of the Health Belief Model. Singapore Medical Journal, 2014. 55(3): p. 160-167.
Campbell et al., Increasing pharmaceutical copayments: impact on asthma medication utilization and outcomes. The American journal of managed care, 2011. 17(10): p. 703-710.
Morishima, M., et al., Analysis of fit pattern of a hygiene mask for an opened mouth. Textile Research Journal, 2016. 86(9): p. 933-947.
Qian, Y., et al., Performance of N95 Respirators: Filtration Efficiency for Airborne Microbial and Inert Particles. American Industrial Hygiene Association Journal, 1998. 59(2): p. 128-132.
Li, Y., et al., In vivo protective performance of N95 respirator and surgical facemask. American Journal of Industrial Medicine, 2006. 49(12): p. 1056-1065.
Li, Y., et al., Antimicrobial effect of surgical masks coated with nanoparticles. Journal of Hospital Infection, 2006. 62(1): p. 58-63.
MacIntyre et al., Face Mask Use and Control of Respiratory Virus Transmission in Households. Emerging Infectious Diseases, 2009. 15(2): p. 233-241.

* cited by examiner

METHOD AND MASK FOR REDUCING INHALATION OF MICROORGANISMS

CROSS-REFERENCE TO RELATED APPLICATIONS

This application claims the benefit of priority of Chinese Invention Patent Application No. 201810196042.5, filed on Mar. 9, 2018, the contents of which being hereby incorporated by reference in their entirety for all purposes.

FIELD OF INVENTION

The present disclosure relates to a method for protection against microorganisms, and in particular, to a method for reducing the inhalation of microorganisms, a mask using this method, and a method for manufacturing the mask.

BACKGROUND OF INVENTION

The statistical data from WHO indicate airborne diseases occur occasionally worldwide. In China, an all-round rapid development exerts pressure on environments, resulting in an atmosphere environment of a lower quality and more germs in air than before. Additionally, in cold seasons such as autumn and winter, a person tends to catch a cold, with a high possibility of germ infection. Moreover, some researches show that lower respiratory tract infection is the third most common cause of death. In recent years, the public pays more attention to respiratory diseases, and there is an increasing demand in masks correspondingly.

As for the ordinary masks which are commercially available, multiple layers of non-woven fabrics or functional cloth are superimposed to filter pathogenic microorganism in air. However, a filtering effect and a respiratory resistance cannot be addressed at the same time. That is, if the effective filtering is realized by superimposing multiple layers of fabrics, the mask is not comfortable to wear due to a large respiratory resistance and poor breathability; if both of the number of filter layers and the respiratory resistance are reduced, the microorganisms such as germs cannot be filtered effectively. Therefore, the mask made by superimposing multiple layers of fabrics usually has a problem that the breathability and the filtering effect cannot be addressed at the same time.

The utility model patent No. CN200957254 discloses a protective mask in which a bacteria-filtering layer is disposed in air holes of a respiratory mask, so as to isolate pathogenic microorganisms such as bacteria and viruses, and protect medical workers. However, bacteria-filtering layer alone is not sufficient to filter viruses and bacteria effectively.

The utility model patent No. CN2616238 discloses a mask for two-way protection against harmful microorganisms, which realizes the effect of killing harmful microorganisms by changing a traditional medical gauze mask into a mask with an interlayer and disposing a functional layer in the interlayer. However, this mask also has the problem that the filtering effect and the respiratory resistance cannot be addressed at the same time.

Due to a very small dimension of the microorganism, for example, viruses have a dimension less than 0.3 micrometers, practically, fabrics with such small apertures are rare. In addition, since the mask should be cleaned after wearing for a period of time, the traditional non-woven fabric mask with a relatively small aperture has a high cost. Moreover, since the non-woven fabric cannot stand washing, the mask made of the non-woven fabric is commonly disposable, thereby further increasing costs. However, knitted fabric and woven fabric with low costs and big apertures cannot achieve the effect of filtering the small-dimension microorganisms.

In natural conditions, particles may impact and attach to fibers due to principles such as gravity, inertia, interception, and Brownian movement, thereby realizing filtering. However, the action force under various natural conditions has the smallest particle filtering effect for particles with a dimension of about 0.3 micrometer. Therefore, filtering particles with a dimension of 0.3 micrometer is one of the main technical problems in the field. In the traditional solution, a mutual action force between fibers and particles is added, thereby making individual particles impact and attach to the fibers as a result of this action force. Since particles have a property of being naturally charged, they cause static electricity in fiber, an electrostatic process method generating a coulomb force is a common method for enhancing fiber-filtering efficiency. In recent years, a method for electrostatic adsorption has been introduced into many new masks on the basis of a traditional filter theory, so as to produce an electrostatic adsorption mask by means of using a replaceable filter disc or a small wearable electrostatic generating device.

However, inherent attribute of electrostatic determines that the electrostatic adsorption mask is more suitable for dry environments, in contrast with the feature that microorganisms tend to live and spread in humid environments. Because the electrostatic-processed mask has a limited performance of filtering microorganisms, such mask is mainly used for filtering physical micro particles (such as PM2.5) at present. Additionally, spray from a person during speaking can easily form a humid environment, which also shortens the service life of the electrostatic-processed mask. Moreover, the electrostatic-processed mask cannot be cleaned, and is usually disposable. Finally, the electrostatic-processed mask has defects of high costs, inconvenient to wear and introducing a secondary source of pollution, etc.

In the field, it is not reported that a magnetic field is used to deflect a moving path of the microorganism, so as to protect against the microorganism. The possible reason is the cognition that the magnetic field may effectively deflect the moving path of the microorganism with a small diameter.

As such, it is difficult for the existing masks to effectively protect against microbiological aerosol in a cost effective and clean-repeatable manner, while addressing breathability at the same time.

SUMMARY OF THE INVENTION

There is needed a method and device for treating microorganisms in any environments, especially in an environment with a relatively high humidity. The present disclosure provides a mask which effectively protects against microbiological aerosol in a cost effective and clean-repeatable manner, while taking breathability into account at the same time.

The present disclosure provides a method for reducing the inhalation of microorganisms, including the steps of:

providing a mask with a breathing zone, the breathing zone being used for covering a breathing part of a user;

arranging two or more magnets around the breathing zone of the mask, the magnets generating a three-dimensional magnetic field, so as to change the moving trajectories of charged microorganisms in gas to be inhaled.

In one aspect, the number of magnets is two, and the two magnets are disposed at the left and right sides of the breathing zone respectively, with an interval between the two magnets, and the polarities of the two magnets are arranged in an opposite manner and along an up-down direction.

In one aspect, the number of magnets is four. The four magnets are located at the upper left, upper right, lower left and lower right of the breathing zone respectively, and the poles of the respective magnets close to an origin are S pole, N pole, S pole and N pole respectively.

In one aspect, the four magnets are arranged counter-clockwise and equidistantly along an angular bisector of four quadrants of a coordinate system, wherein an X axis of the coordinate system is the horizontal direction and a Y axis of the coordinate system is the vertical direction; the resulting magnetic field has a central axis being a straight line passing through the origin of the coordinate system in a direction perpendicular to the mask, and is distributed radially in the form of an analogous hyperbola.

In one aspect, the mask has an outer layer, an inner layer and an intermediate layer, wherein the intermediate layer is located between the outer layer and the inner layer, and contains antimicrobial fiber.

In one aspect, the antimicrobial fiber has a knitted, woven or non-woven fabric structure.

The present disclosure further provides a mask for reducing the inhalation of microorganisms, including:

a fabric portion including at least an outer layer and an inner layer;

at least two magnets arranged around a breathing zone on the fabric portion, so as to generate a three-dimensional magnetic field, thereby changing the moving trajectories of charged microorganisms in gas to be inhaled.

In one aspect, the number of magnets is two, and the two magnets are disposed at the left and right sides of the breathing zone respectively, with an interval between the two magnets, and the polarities of the two magnets are arranged in an opposite manner and along an up-down direction.

In one aspect, the magnets have a shape of a vertical bar, and are disposed along an up-down direction.

In one aspect, the number of magnets is four. The four magnets are located at the upper left, upper right, lower left and lower right of the breathing zone respectively, and the poles of the respective magnets close to an origin are S-pole, N-pole, S-pole and N-pole respectively.

In one aspect, the four magnets are arranged counter-clockwise and equidistantly along an angular bisector of four quadrants of a coordinate system, wherein an X axis of the coordinate system is the horizontal direction and a Y axis of the coordinate system is the vertical direction; the resulting magnetic field has a central axis being a straight line passing through the origin of the coordinate system in a direction perpendicular to the mask, and is distributed radially in the form of an analogous hyperbola.

In one aspect, the magnet is washable.

In one aspect, the fabric portion further includes an intermediate layer, and the intermediate layer is located between the outer layer and the inner layer and contains antimicrobial fiber.

In one aspect, the antimicrobial fiber has a knitted, woven or non-woven fabric structure.

In one aspect, the outer layer and the inner layer are both made of cotton or chitin knitted fabric.

In one aspect, the magnet is a magnetic sheet or a magnetic coating which is located at the outer layer or the intermediate layer.

In one aspect, the magnetic field generated by the magnets has an intensity of 20-100 Gauss.

In one aspect, the magnets are located on at least two positions selected from an upper edge of the mask at the nose bridge, a lower edge of the mask at the jaw, the left side of the mask at one cheek and the right side of the mask at the other cheek.

The present disclosure further provides an application of the mask for reducing the inhalation of microorganism as described above.

The present disclosure further provides a method for manufacturing the above-mentioned mask, including the steps of:

preparing a fabric portion of the mask, the fabric portion including at least an outer layer and an inner layer;

arranging at least two magnets around a breathing zone on the fabric portion, so as to generate a three-dimensional magnetic field, thereby changing the moving trajectories of charged microorganisms in gas to be inhaled.

In one aspect, the fabric portion further includes an intermediate layer, and the intermediate layer is located between the outer layer and the inner layer and contains antimicrobial fiber.

In one aspect, the antimicrobial fiber has a knitted, woven or non-woven fabric structure.

Compared with traditional masks, the present disclosure addresses the protective effect and breathability of the mask at the same time, and is targeted to protect against microorganisms and is not affected by environment humidity. Additionally, the mask according to the present disclosure is washable, and may be repeatedly used. What's more important, in the case of addressing the protective effect and breathability at the same time, due to the adoption of the antimicrobial knitted, woven, or non-woven fiber filter layer, the mask according to the present disclosure has a remarkably low cost and is durable.

BRIEF DESCRIPTION OF DRAWINGS

With reference to the following detailed description, the embodiments of the present disclosure and their advantages may be readily understood. It should be appreciated that like reference numerals are used for denoting like elements shown in one or more drawings.

DETAILED DESCRIPTION OF EMBODIMENTS

Figure 1:
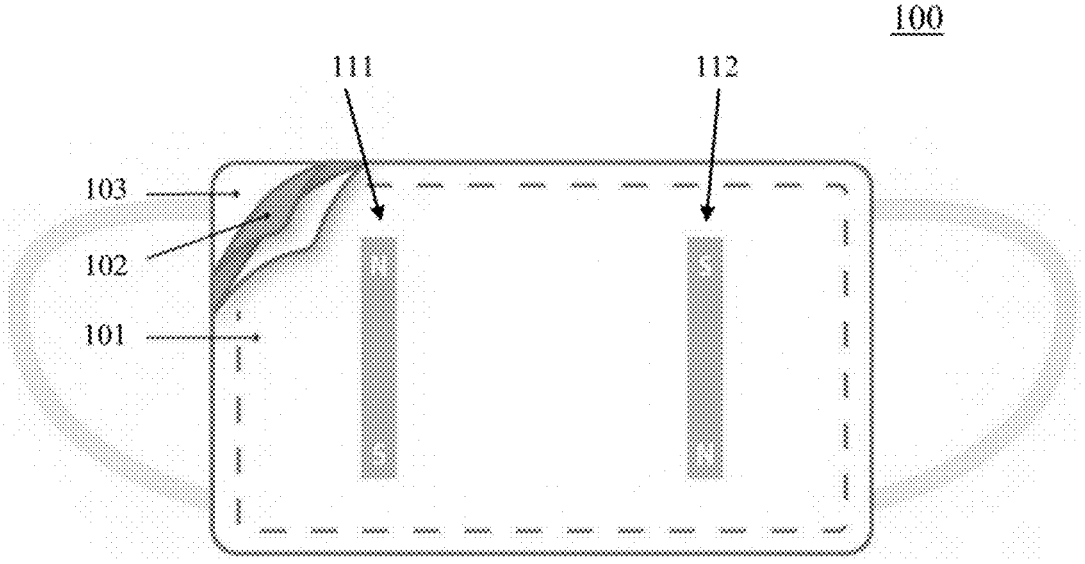
FIG. 1 is a schematic diagram of a mask according to one embodiment of the present disclosure.

The following describes typical embodiments of the present disclosure, which is not intended to limit the scope or application of the present disclosure in any manner. To the contrary, the following description is intended to provide examples for implementing various embodiments of the present disclosure.

A skilled person should note that the elements in the drawings are illustrated for the sake of simplicity and clearness and are not necessarily drawn to scale. For example, the relative dimensions of some elements in the drawings may be distorted so as to be helpful for understanding the embodiments of the present disclosure.

It is unexpectedly discovered by the applicant that although a dimension of microorganisms is much smaller than that of a PM2.5 particle, a moving trajectory of microorganisms may be changed by providing a three-dimensional magnetic field, utilizing the charged characteristics of microorganisms such as bacteria and virus in the aerosol, thereby increasing the possibility of capturing microorganisms by antimicrobial fiber, and increasing microorganism filtering efficiency.

According to one embodiment of the present disclosure, there is provided a method for reducing the inhalation of microorganisms using a magnetic field, which effectively increases protection performance against microorganisms by introducing the three-dimensional magnetic field. Specifically, the method includes the steps of providing a mask with a breathing zone, the breathing zone covering a breathing part of a user; arranging two or more magnets around the breathing zone of the mask, which is intended to cover mouth and nose, the magnets generating a three-dimensional magnetic field, so as to change the moving trajectories of the charged microorganisms in gas to be inhaled, thereby reducing the inhalation of microorganisms.

The charged microorganisms (particles) are deflected after entering the magnetic field, due to influence of a Lorentz force. The Lorentz force exerted on the microorganisms with an electric charge of q and entering the magnetic field B at a speed of $\vec{\upsilon}$ is $\vec{F}=q\times\vec{\upsilon}\times\vec{B}$. The trajectories of the microorganisms are deflected, which increases the probability of the microorganisms being captured by the filtering material, so that the microorganisms in an air flow are filtered more effectively.

The present disclosure provides a mask for reducing the inhalation of microorganisms. The mask comprises: a fabric portion including at least an outer layer and an inner layer; at least two magnets arranged around a breathing zone on the fabric portion, so as to generate a three-dimensional magnetic field, thereby changing the moving trajectories of the charged microorganisms in the gas to be inhaled.

According to one embodiment of the present disclosure, a mask is provided. The mask includes a fabric portion which has at least two layers, i.e. an outer layer and an inner layer. Both of the outer layer and the inner layer may be made of cotton cloth and/or knitted fabric, for example, cotton or chitin knitted fabric. The outer layer and the inner layer may also be made of other materials, and can be made by the same or different materials. At one of the layers of the mask, for example, at the outer layer, magnetic sheets are disposed at a specific position around the breathing zone, so as to generate the three-dimensional magnetic field, thereby changing the moving trajectories of the charged microorganisms in the gas to be inhaled. In the present embodiment, the number of magnetic sheets is two. It suffices to have at least two magnetic sheets. It may also have more, for example, three, four or five, etc. The three-dimensional magnetic field may be generated by applying a magnetic material coating on the mask. The magnetic sheets or the magnetic material coating are located near the breathing zone of the nose and mouth, for example, an upper edge of the mask at the nose bridge, a lower edge of the mask at the jaw, and the left side and right side of the mask at the cheeks. The magnetic sheets or the magnetic material coating are washable, so that the mask may be repeatedly used.

As shown in FIG. 1, another embodiment according to the present disclosure is shown, providing a mask using the method for reducing the inhalation of microorganisms. The mask 100 has at least three layers, i.e., an outer layer 101, an intermediate layer 102 and an inner layer 103, wherein the outer layer 101 and the inner layer 103 may be made of cotton cloth or knitted fabric, for example, cotton or chitin knitted fabric; the intermediate layer 102, that is a filter layer, may be made of a material with filtering function, for example, the fabric used is antimicrobial fiber, with the feature of killing viruses and bacteria. The outer layer and the inner layer may be made of other materials, and may be made of the same or different materials. The intermediate layer 102 has a knitted, woven, or non-woven fabric structure, and the non-woven form is preferable. The above-mentioned fabric structure is washable and has a low price, thereby allowing the mask according to the present disclosure to be used repeatedly. The intermediate layer 102 of the mask 100 may be a replaceable filter disc. For example, edges of the outer layer and the inner layer are combined together at three sides, whereas the fourth side is open, for example, the right side is open, for placing or removing the intermediate layer. The size of the intermediate layer 102 may be smaller than those of the outer layer and the inner layer, for convenient placement. When the filter disc is used for a period of time, the wearer may replace the filter disc by himself depending on the specific condition of the filter disc, thereby not replacing the whole mask and saving costs. The outer layer 101, the intermediate layer 102 and the inner layer 103 may be connected together to be fastened, for example, by sewing and compacting.

The magnetic sheets are disposed at a specific position on one layer of the mask. In the present embodiment, a weak magnetic field around the mask is generated by placing magnetic sheets on its outer layer. In the present embodiment, the number of magnetic sheets is two, i.e., a left magnetic sheet 111 and a right magnetic sheet 112. It suffices to have at least two magnetic sheets. It may also have more, for example, three, four or five, etc., so as to generate the three-dimensional magnetic field. The three-dimensional magnetic field may also be generated by applying a magnetic material coating onto the mask. The magnetic sheets or the magnetic material coating may be located near the breathing zone of the nose and mouth, for example, an upper edge of the mask at the nose bridge, a lower edge of the mask at the jaw, and the left side and right side of the mask at the cheeks. In the present embodiment, the left magnetic sheet 111 and the right magnetic sheet 112 are placed at left and right sides of the breathing zone respectively, i.e., positions close to the left and right sides of the cheek. The two magnetic sheets are arranged at a predetermined interval, between which the breathing zone is mainly located. The two magnetic sheets have a shape of vertical bars, and are placed vertically along an up-down direction. The two magnetic sheets are placed such that an N-pole and an S-pole of the left magnetic sheet 111 are located at the lower and upper portions respectively, an N-pole and an S-pole of the right magnetic sheet 112 are located at the upper and the lower portions respectively, thereby generating the weak three-dimensional magnetic field around the breathing zone and mask by two magnetic sheets. The magnetic sheets or the magnetic material coating are washable, so that this mask may be repeatedly used. The magnetic sheets or the magnetic coating may change the intensity of the magnetic field as needed. The magnetic sheets are more preferable, because the intensity of their magnetic field is about 20~100 Gauss. The magnetic sheets or the magnetic material may be added onto the filter layer or the outer layer, preferably onto the outer layer. The charged microorganisms are deflected to the poles after entering the magnetic field due to an influence of a Lorentz force, thereby changing the moving trajectories, even to the extent of moving the microorganisms away from the breathing zone.

The present embodiment is a design of mask for effectively protecting against the microorganisms. Its efficiency is increased by superimposing fabric filtering, magnetic deflection and fabric sterilization, that is, by adding magnetic sheets or the magnetic coating on the mask fabric. The intensity of the magnetic field may be adjusted by changing the amount of magnetic material and the magnetic field configuration as needed. According to testing results, the mask according to the present embodiment increases the effect of filtering bacteria as compared with a single-layer antimicrobial non-woven fabric by 65.9% to 79.2%, without changing the breathing resistance.

Advantageously, the masks provided herein can optionally be washed and reused without substantially effecting the protection against microorganisms provided by the mask. Thus, the masks provided herein can be washed and reused after washing. The washable design of the masks provided herein can at least partially extend the life of the mask, assist in maintaining the mask's substantially unsoiled appearance, and lower end user costs. In certain embodiments, the mask can be washed 1, 2, 3, 4, 5, or more times without substantially affecting the protection against microorganisms.

In addition, in the present disclosure, the magnetic field generated by the magnet can penetrate the fabric and exist in the three-dimensional space, thereby effectively improving protection effect, without influencing the breathability of the mask. The characteristics of the magnetic material of the present disclosure are not influenced by liquid, and may be applied in various humidity environments. In the present disclosure, the knitted fabric and filter layer are formed by the non-woven fabric, and the magnetic sheets are also washable, such that the magnetic sheets and the fabric are washable, and may be used repeatedly, which further lowers costs.

In one preferable embodiment according to the present disclosure, the mask 100 according to the present disclosure may be formed with sealing structures at the two sides of the breathing zone, such that the microorganisms attached to the side portion cannot enter the mask. The mask may have a groove (not shown) at the position of nose bridge, corresponding to the nose of the wearer, such that the mask fits the face of the wearer well, and the sealing function is realized. One of the magnets may be arranged in the groove for fixing, such that the moving trajectories of the charged microorganisms can be changed. A fastening belt at the two sides of the mask is connected to the fabric portion of the mask through a fastening belt hole located at the mask, or by sewing.

The weak three-dimensional magnetic field is achieved on the mask according to the present disclosure. The moving trajectories of the charged microorganism are changed by the Lorentz force exerted by the magnetic field, and thus the possibility of capturing the charged microorganisms by antimicrobial fiber is increased. Therefore, the superimposition of the fabric filtering and magnetic filtering can be achieved, without influencing the mask breathability or increasing the breathing resistance of the mask additionally. With combination of the antimicrobial property of the antimicrobial fabric, the filtering performance of microorganisms is effectively improved, and the protection effect of the mask against the microorganisms is greatly enhanced. Meanwhile, since the chance of the microorganisms being captured is increased, the present disclosure allows the knitted, woven, or non-woven fabric structure, which is washable and has low costs. In addition, since the fabric used in the present disclosure is antimicrobial fiber, with sterilizing property, thereby effectively reducing the secondary transmission of microorganisms.

Figure 2:
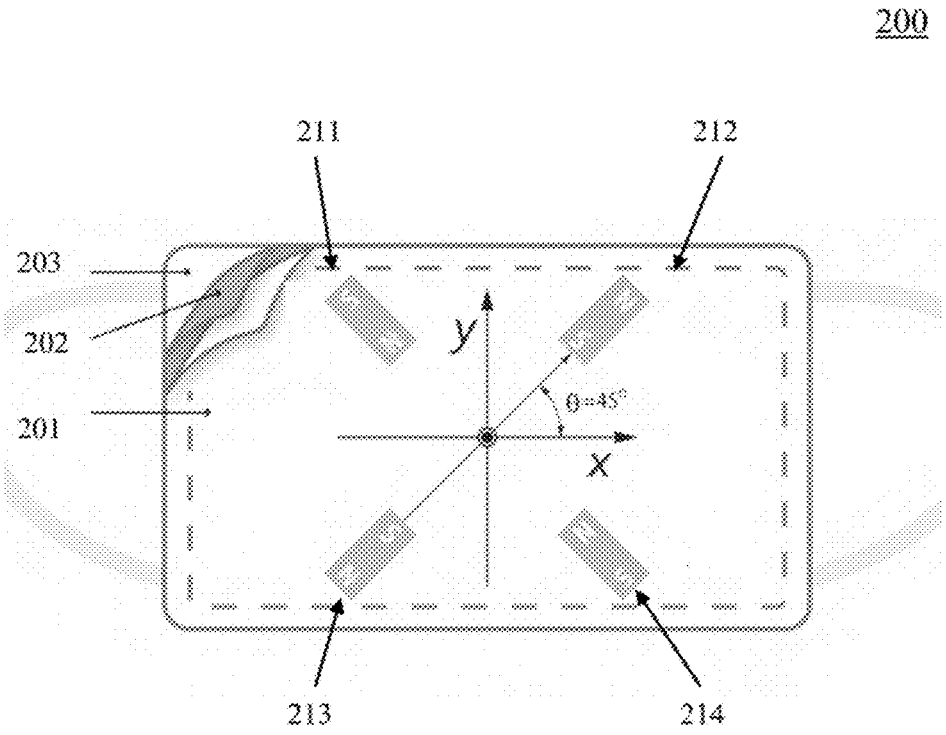
FIG. 2 is a schematic diagram of a mask according to another embodiment of the present disclosure.
Figure 3:
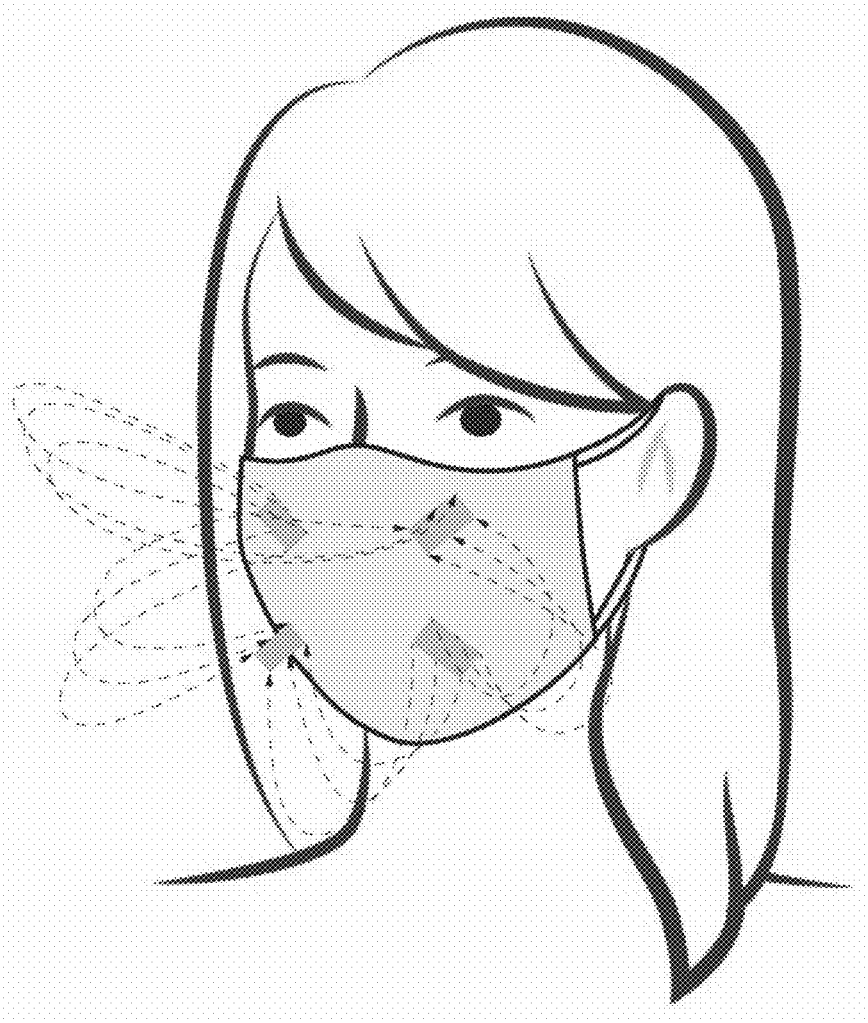
FIG. 3 is a schematic diagram of a three-dimensional magnetic field of a mask according to the embodiment as shown in FIG. 2.

As shown in FIG. 2, another embodiment according to the present invention is shown, providing a mask using the method for reducing the inhalation of microorganism. The mask 200 has at least three layers, i.e. an outer layer 201, an intermediate layer 202 and an inner layer 203, wherein the outer layer 201 and the inner layer 203 may be made of cotton cloth or knitted fabric. The three-layer structure of the mask 200 is substantially the same as the three-layer structure of the mask as shown in FIG. 1. The magnetic sheets are disposed at specific positions on one layer of the mask. In the present embodiment, the weak magnetic field around the mask is generated by disposing the magnetic sheets on its outer layer. In the present embodiment, the number of magnetic sheets is four, that is, an upper left magnetic sheet 211, an upper right magnetic sheet 212, a lower left magnetic sheet 213 and a lower right magnetic sheet 214. As described above, other numbers of the magnetic sheets are possible, to generate the three-dimensional magnetic field. The four magnetic sheets are disposed at a predetermined distance, for example, at an upper left position and an upper right position of the mask which are near the positions at the nose bridge, as well as at left-side and right-side positions at the lower left and lower right cheeks respectively and are adjacent to the jaw. A roughly circular region surrounded by the magnetic sheets is a main breathing zone. In the present embodiment, the magnetic sheets are elongated, and the upper left magnetic sheet 211, the upper right magnetic sheet 212, the lower left magnetic sheet 213 and the lower right magnetic sheet 214 are arranged equidistantly on an angular bisector of first, second, third and fourth quadrants, in a coordinate system which takes the geometric center of the mask as an origin, the horizontal direction as the x axis, and the vertical direction as the y axis. Therefore, the direction of each magnetic sheet extending along N-pole to S-pole has a 45-degree angle with respect to the x axis and the y axis respectively, that is, $\theta=45°$. The magnetic poles of the four magnetic sheets close to the origin are S-pole, N-pole, S-pole and N-pole respectively. FIG. 3 shows the three-dimensional magnetic field generated when the mask according to the embodiment as shown in FIG. 2 is worn. The resulting magnetic field has a central axis being a straight line passing through the origin perpendicularly to the mask, and is distributed radially in the form of an analogous hyperbola. The intensity of the magnetic field enhances as the radial distance increases. Under the influence of this three-dimensional magnetic field, the charged microorganisms may deflect from the breathing zone quickly. Therefore, the four magnetic sheets generate the weak three-dimensional magnetic field around the breathing zone and the mask. In this embodiment, the magnetic sheets or the magnetic material coating are washable, so that this mask can be repeatedly used. The magnetic sheets or the magnetic coating may change the intensity of the magnetic field as needed. The magnetic sheets are more preferable, because the intensity of their magnetic field is about 20~100 Gauss. The magnetic sheets or the magnetic material may also be added onto the filter layer.

According to one preferable embodiment of the present disclosure, there is provided an application of the mask for reducing the inhalation of microorganism as described above.

According to one preferable embodiment of the present disclosure, there is further provided a method for manufacturing the above-mentioned mask, including the steps of: preparing a fabric portion of the mask, the fabric portion including at least an outer layer and an inner layer, preferably, further including an intermediate layer, i.e., a filter layer. The outer layer and the inner layer may be made of the same or different materials, such as cotton cloth or knitted fabric, for example, cotton or chitin knitted fabric. The intermediate layer may be a material with filtering function, for example, the fabric used is antimicrobial fiber, for example, the antimicrobial fiber non-woven fabric, so as to kill viruses and bacteria. The intermediate layer has a knitted, woven, or non-woven fabric structure, and the non-woven form is preferable. The intermediate layer may be made by sewing, and thus is replaceable. The outer layer, the intermediate layer and the inner layer may also be connected together to be fastened. At least two magnets are arranged at the fabric portion, and may be located at the outer layer or the inner layer. The magnets may be attached or coated, so as to generate the three-dimensional magnetic field around the breathing zone of the mask, thereby changing the moving trajectories of the charged microorganisms in the inhaled gas, even to the extent of moving the microorganisms away from the breathing zone of the mask. The number of magnetic sheets is two or more, and may be disposed in the way as described above.

The terminologies used herein are merely for the purpose of describing particular examples of the embodiments and is not intended to be limiting of the present disclosure. As used herein, "upper", "lower", "left" and "right" may only be illustrative, unless the context clearly indicates otherwise. The terms "comprises," "comprising," "includes," "including," "have," "has," and "having," are inclusive and therefore specify the presence of the stated features, integers, steps, operations, elements, and/or components, but do not preclude the presence or addition of one or more other features, integers, steps, operations, elements, components, and/or groups thereof. It is unnecessary to construe the steps, processes, and operations of the method described herein being performed in the discussed or illustrated particular order, unless an order of execution has been specifically indicated. It should also be understood that additional or alternative steps may be employed.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if it is not specifically shown or described. The same situation may also be varied in many aspects. Such variations are not to be regarded as a departure from the disclosure, and all such modifications are intended to be included within the scope of the disclosure.

What is claimed is:

1. A mask for reducing the inhalation of microorganisms, comprising:

a fabric portion comprising at least an outer layer and an inner layer;

four magnets arranged around a breathing zone on the fabric portion, so as to generate a three-dimensional magnetic field, thereby changing the moving trajectories of charged microorganisms in gas to be inhaled, wherein two of the four magnets are disposed at the left and right sides of the breathing zone respectively, with an interval between the two magnets, and the polarities of the two magnets are arranged in an opposite manner; the tour magnets are located at the upper left, upper right, lower left and lower right of the breathing zone respectively, and the poles of the respective magnets close to an origin are S pole, N pole, S pole and N pole, respectively; the four magnets are arranged counterclockwise, and each of the four magnets is arranged equidistantly along an angular bisector of a respective quadrant of four quadrants of a coordinate system, wherein an X axis of the coordinate system is the horizontal direction and a Y axis of the coordinate system is the vertical direction, the direction a each of the four magnets extending along N pole to S pole has a 45-degree angle with respect to the X axis and the Y axis respectively; and the resulting magnetic field has a central axis being a straight line passing through the origin of the coordinate system in a direction perpendicular to the mask, and is distributed radially in the form of an analogous hyperbola, such that intensity of the magnetic field enhances as radial distance increases.

2. The mask according to claim 1, wherein the mask is washable.

3. The mask according to claim 1, wherein the fabric portion further comprises an intermediate layer, and the intermediate layer is located between the outer layer and the inner layer and contains an antimicrobial fiber.

4. The mask according to claim 3, wherein the antimicrobial fiber has a knitted, woven or non-woven fabric structure.

5. The mask according to claim 1, wherein the outer layer and the inner layer are both made of cotton or chitin knitted fabric.

6. The mask according to claim 1, wherein each of the four magnets is a magnetic sheet or a magnetic coating which is located at the outer layer or an intermediate layer.

7. The mask according to claim 1, wherein the magnetic field generated by the magnets has an intensity of 20-100 Gauss.

8. The mask according to claim 1, wherein the four magnets are configured to be located on at least two positions selected from an upper edge of the mask at the nose bridge, a lower edge of the mask at the jaw, the left side of the mask at one cheek and the right side of the mask at the other cheek.

9. A method for manufacturing the mask according to claim 1, comprising the steps of:

preparing a fabric portion of the mask, the fabric portion comprising at least an outer layer and an inner layer;

four magnets around a breathing zone on the fabric portion, so as to generate a three-dimensional magnetic field, thereby changing the moving tracks trajectories of charged microorganisms to be inhaled in gas to be inhaled, wherein two of the four magnets are disposed at the left and right sides of the breathing zone respectively, with an interval between the two magnets, and the polarities of the two magnets are arranged in an opposite manner; the four magnets are located at the upper left, upper right, lower left and lower right of the breathing zone respectively, and the poles of the respective magnets close to an origin are S pole, N pole, S pole and N pole, respectively; the four magnets are arranged counterclockwise, and each of the four magnets is arranged equidistantly along an angular bisector of a respective quadrant of four quadrants of a coordinate system, wherein an X axis of the coordinate system is the horizontal direction and a Y axis of the coordinate system is the vertical direction, the direction of each of the four magnets extending along N pole to S pole has a 45-degree angle with respect to the X axis and the Y axis respectively; and the resulting magnetic field has a central axis being a straight line passing through the origin of the coordinate system in a direction perpendicular to the mask, and is distributed radially in the form of an analogous hyperbola, such that intensity of the magnetic field enhances as radial distance increases.

10. The method according to claim 9, wherein the fabric portion further comprises an intermediate layer, and wherein the intermediate layer is located between the outer layer and the inner layer and contains an antimicrobial fiber.

11. The method according to claim 10, wherein the antimicrobial fiber ha a knitted, woven or non-woven fabric structure.

* * * * *